United States Patent [19]

Brenneman

[11] Patent Number: 4,927,161

[45] Date of Patent: May 22, 1990

[54] CHIP SHOT GAME

[76] Inventor: Rex D. Brenneman, 2244 Osage, Wichita, Kans. 67213

[21] Appl. No.: 340,801

[22] Filed: Apr. 20, 1989

[51] Int. Cl.[5] ..... A63B 67/06

[52] U.S. Cl. ..... 273/402; 273/425

[58] Field of Search ..... 273/401, 402, 400, 424, 273/425, 338, 398, 336, 427, 428, 415, 339

[56] References Cited

U.S. PATENT DOCUMENTS

| | | | |
|---|---|---|---|
| 922,717 | 5/1919 | Parker | 273/401 |
| 2,476,532 | 7/1949 | Bouchard | 273/336 |
| 3,119,619 | 1/1964 | Frank | 273/336 |
| 3,815,915 | 6/1974 | Chapman | 273/338 |
| 4,012,042 | 3/1977 | Blasingame | 273/401 |
| 4,168,066 | 9/1979 | Sole et al. | 273/402 |
| 4,203,592 | 5/1980 | Quatkemeyer | 273/398 X |
| 4,273,340 | 6/1981 | Hackett | 273/336 |
| 4,314,702 | 2/1982 | Updike et al. | 273/336 |
| 4,822,053 | 4/1989 | Flaherty | 273/411 |

FOREIGN PATENT DOCUMENTS

| | | | |
|---|---|---|---|
| 532082 | 1/1922 | France | 273/399 |

*Primary Examiner*—William H. Grieb

*Attorney, Agent, or Firm*—Frank A. Lukasik

[57] ABSTRACT

A new and useful projectile throwing game. The game consists of two platforms with three circular holes in each platform. These platforms are joined together with a chain or other linkage at a fixed distance. A player stands on top of the platform at the end where the linkage is fastened. This player will toss, pitch, or lob all three disks, one at a time, towards the other platform trying to hit one of the three holes. Each hole is worth a particular number of points.

3 Claims, 1 Drawing Sheet

CHIP SHOT GAME

BACKGROUND OF THE INVENTION

1. Field of the invention

This invention relates to games and more particularly to a game in which objects are pitched at a fixed distance to a target area and points are scored in accordance with the position of the target hole located in the target area.

2. Description of the prior art

Games requiring skill in the tossing of an object toward a target are well known in the art. One example of such a game is U.S. Pat. No. 922,717, issued to Parker, on May 25, 1909, which discloses a series of openings enclosed below by flexible pockets of a size to receive a bean bag which serves the purpose of a quoit. The device is so constructed that it may be elevated to an inclined position or it may be folded compactly within a supporting case and carried in the hand much after the fashion of a grip. The quoits are of circular form and are each supplied with a sufficient number of beans to permit the quoits to have a certain flexibility and flattened form in order that they may not bounce or roll when pitched. U.S. Pat. No. 4,012,042, issued to Blasingame, on Mar. 15, 1977, shows a game utilizing at least one target tray structure having a pocket at which disc shaped projectiles are thrown. The tray is invertable to provide either a single pocket of a predetermined scoring value or to provide an array of pockets having various scoring values. The target tray structure is provided with a planar floor which serves as a common bottom for a pair of trays that are disposed in a back to back relationship. U.S. Pat. No. 4,203,592, issued to Quatkemeyer on May 20, 1980, discloses a game in which annular discs or rings are pitched or tossed at targets provided on each of two similar game mats. Each game comprises a small piece of carpet-like material having a stake extending above it and disposed immediately behind a circular aperture of greater diameter than the annular discs or rings. The game mats are spaced by approximately 20 feet and the rings are tossed from one game mat toward the other game mat. Points are given according to the proximity of the ring to the aperture after the ring has landed. If a player is able to produce a "ringer" by having the ring land directly over the stake, he wins automatically.

SUMMARY OF THE INVENTION

In accordance with the present invention, a new and useful projectile throwing game is disclosed which employs at least two target tray structures and a plurality of projectiles. Two or four players may play this game. The game consists of two platforms with three circular holes in each platform. These platforms are joined together with a chain or other linkage at a fixed distance. A player stands on top of the platform at the end where the linkage is fastened. This player will toss, pitch, or lob a disc towards the other platform trying to hit one of the holes. Each hole is worth a particular number of points. Generally a player who scores the first 21 points, wins the game.

Accordingly, it is an object of the present invention to provide a new and improved throwing game and apparatus therefore.

Another object of this invention is to provide a new and improved throwing game and apparatus therefore which includes at least two target tray structures and a plurality of projectiles.

Still another object of this invention is to provide a new and improved throwing game and apparatus therefore which includes at least two target tray structures joined together in a spaced relationship by a chain or other linkage.

These together with other objects and advantages which will become subsequently apparent reside in the details of construction and operation as more fully hereinafter described and claimed, reference being had to the accompanying drawings forming a part hereof, wherein like numerals refer to parts throughout.

DESCRIPTION OF THE PREFERRED EMBODIMENT

Figure 1:
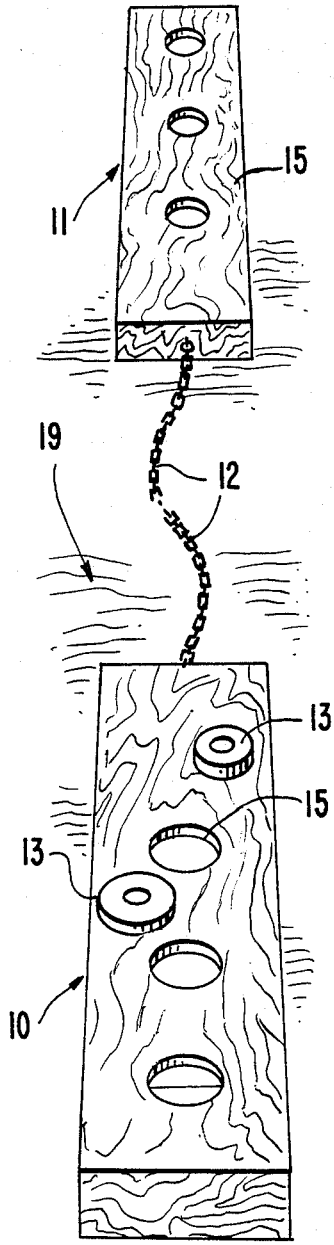
FIG. 1 is a perspective view illustrating the throwing game and apparatus of the instant invention with linkage and throwing discs.

Now with reference to the drawing, FIG. 1 illustrates the preferred embodiment of the game of the present invention as including a pair of identical target structures which are indicated generally by the reference numerals 10 and 11. As shown in FIG. 1, the target structures 10 and 11 are spaced apart a suitable distance, preferably joined together with a ten foot linkage 12. As shown in FIG. 1, the target structures 10 and 11 are spaced apart a suitable distance so that a plurality of projectiles 13 may be tossed, pitched, or lobbed from the proximity of the target structure 10 toward the target structure 11. When all of the projectiles 13 have been thrown toward the target structure 11 and the scoring has been compiled, as will hereinafter be described, the throwing of the projectiles will be in the opposite direction from the target structure 11 toward the target structure 10. This throwing from one target structure to the other will continue until one of the players has compiled a predetermined score.

Figure 2:
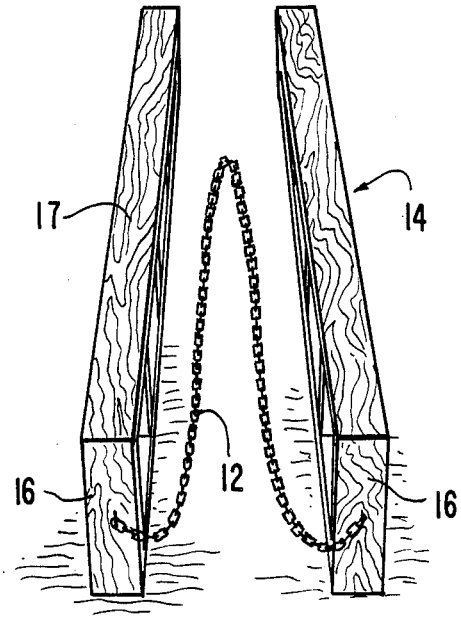
FIG. 2 is an edge view of the target structures of the instant invention.
Figure 3:
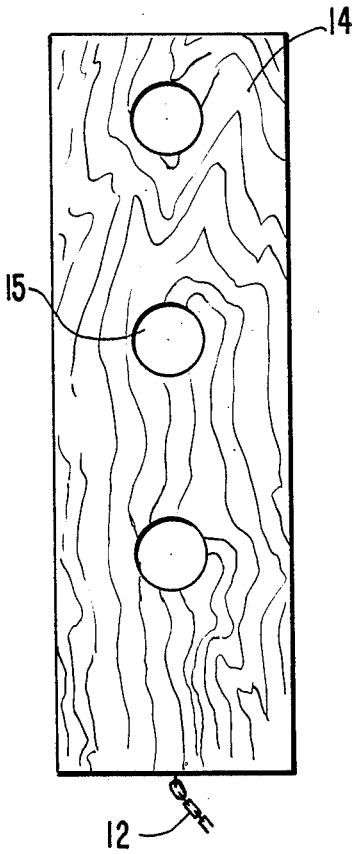
FIG. 3 is a top view of a target structure of the instant invention.
Figure 4:
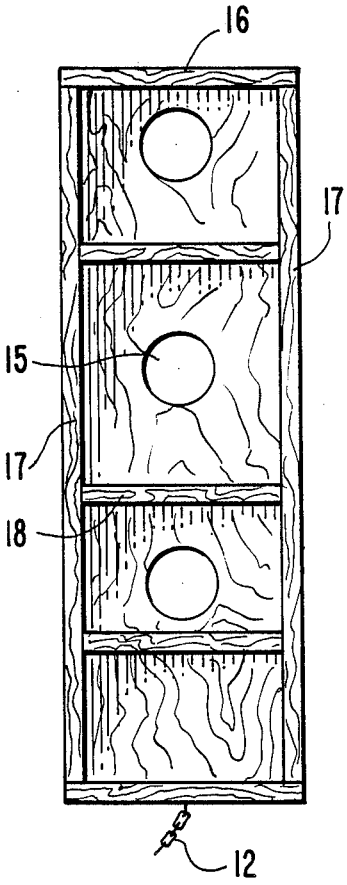
FIG. 4 is a bottom view of a target structure of the instant invention.

Since the target structures 10 and 11 are identical, it will be understood that the following description of the target structure 10 also applies to the target structure 11. FIG. 2 shows the target structures standing on edge with the linkage 12 connecting the two structures. As best seen in FIGS. 3 and 4, the target structure 10 comprises a target board 14 of substantially rectangular configuration having its opposite side edges supportingly connected to a pair of spaced apart side supports 16 and having its opposite side ends supported by end supports 17. Interior supports 18 are provided as shown in FIG. 4 to provide additional support for target board 14 and to provide a more rugged structure sufficiently strong to support the weight of the players. The target structures 10 and 11 may be fabricated from a suitable material such as wood, or other materials such as, for example, plastic or metal.

FIG. 1 illustrates the preferred form of the projectiles 13 as being washer shaped structures which are ideally sized approximately 2½ inches in diameter and in two different colors. However, it should be understood that other types of projectiles, such as bean bags, (not shown) could be employed in the game and apparatus of the present invention. The number of projectiles 13 employed is suggested to be three per player with the rings being color coded in two colors to differentiate those of the different players.

Two or four players may play this game. The game comprises two target structures with three holes in each platform. These holes are preferably four inches in diameter. The target structures are joined together with a ten foot linkage.

A player stands on a target structure at the end where the linkage is fastened, not letting his or her toes to extend over the edge. This player will toss, pitch, or lob a disk towards the other target structure, trying to get it in one of the holes. To gain points, (facing the other structure) the first hole is worth one point, the second hole is worth three points and the third hole is worth five points. For example, if the first player puts a disk into the second hole, the player will have three points. If the next player puts a disk into the same hole, this will cancel the three points that the first player had. However, this does not mean that this same player gets the three points for all the player did was to cancel the first player's points.

If only two players are in the game, they will both throw from the same end. After each player has tossed three disks, they will go to the other target structure and pick up their disks according to their color and toss the disks back to the other platform. If both players score, the player that scores last will toss first. If at anytime a player has thrown all three disks and the other player tosses a disk and it hits another disk not belonging to the player knocking it into the hole, the points are awarded to the player whose color scores, whether the points are needed or not. If four players are playing, one player from each team will be at each target platform.

The principle of the game is to try to score twenty one points before the opponents do. The player or team that scores the first twenty one points wins the game. If a team has eighteen points and needs three points to win, a player could toss a disk into the number three hole, or attempt to toss three disks into the one point hole. If a disk falls into the number five hole, the score would be thirteen (because of the −5 points). If a player or team have sixteen, eighteen, or twenty points, they could go out with one disk. If this should happen, they will have to hit the top of the platform with the remaining disks. The player cannot toss the other disk or disks with the intention of not hitting the target structure. If the remaining disks do not hit the top of the platform, the game is continued. This happens only if a player has a disk or disks remaining after reaching twenty one points.

The game can be played indoors as well as outdoors. After a few games and sufficient practice a player will determine how to toss the disc, how to stand, and how to follow through when tossing the disks in order to score points.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim is:

1. A throwing game and device wherein projectiles are tossed, pitched or lobbed by players standing on a first target area at a second target area comprising:

a pair of target structures each being formed in a rectangular, shallow, box shape and each having front, back, said and inside supports sufficiently strong to support the weight of said players;

a target area having a plurality of circular openings adapted to be supported on top of each of said target structures;

a linkage adapted to connect said pair of target structures in a fixed, spaced apart relationship; and a plurality of projectiles for pitching at said target areas.

2. The game and device of claim 1 wherein each of said target areas contains three, four inch diameter holes having point values of one, three, and five points.

3. The game and device as set forth in claim 1 wherein said projectiles comprise at least six, two and one half inch disks, and said linkage comprises a ten foot line.

* * * * *